US007255612B2

(12) United States Patent
Noguchi

(10) Patent No.: US 7,255,612 B2
(45) Date of Patent: Aug. 14, 2007

(54) COMPLIANT PIN AND ELECTRICAL COMPONENT THAT UTILIZES THE COMPLIANT PIN

(75) Inventor: Yukio Noguchi, Kanagawa (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 11/379,846

(22) Filed: Apr. 24, 2006

(65) Prior Publication Data

US 2006/0246786 A1 Nov. 2, 2006

(30) Foreign Application Priority Data

Apr. 28, 2005 (JP) ..... 2005-130829

(51) Int. Cl.
*H01R 13/42* (2006.01)

(52) U.S. Cl. ..... 439/751; 439/82

(58) Field of Classification Search ..... 439/751, 439/82, 819, 825
See application file for complete search history.

(56) References Cited

U.S. PATENT DOCUMENTS 4,186,982 A * 2/1980 Cobaugh et al. ..... 439/82
4,655,537 A * 4/1987 Andrews, Jr. ..... 439/751
4,698,026 A * 10/1987 Rolf ..... 439/82
4,735,575 A * 4/1988 Shaffer ..... 439/82
5,073,119 A * 12/1991 Soes ..... 439/82
5,139,446 A * 8/1992 Costello et al. ..... 439/751
6,672,886 B2 * 1/2004 Billman ..... 439/82
7,044,807 B2 * 5/2006 Furuno et al. ..... 439/751

FOREIGN PATENT DOCUMENTS

JP 50044491 4/1975
JP 57043062 3/1982
JP 2002-231354 8/2002

* cited by examiner

*Primary Examiner*—Michael C. Zarroli
(74) *Attorney, Agent, or Firm*—Barley Snyder LLC

(57) ABSTRACT

An electrical component comprises a housing having a plurality of compliant pins. A circuit board is provided with though-holes. Each of the through-holes has an inner surface with a plating layer. Each of the compliant pins has an elastic press-fit portion with an outer surface provided with a step. The step has an engaging surface that engages the plating layer of the though-hole to secure the compliant pin therein. The engaging surface has a width in a direction substantially perpendicular to the inner surface of the through-hole smaller than a thickness of the plating layer.

20 Claims, 6 Drawing Sheets

COMPLIANT PIN AND ELECTRICAL COMPONENT THAT UTILIZES THE COMPLIANT PIN

FIELD OF THE INVENTION

The invention relates to a compliant pin configured to be press-fit into through-holes of a circuit board and an electrical component that utilizes the compliant pin.

BACKGROUND OF THE INVENTION

Compliant pins comprise press-fit portions, which have elasticity. The compliant pins are press-fit into through-holes in a circuit board that have inner diameters slightly smaller than outer diameters of the press-fit portions. When the pins are press-fit into the through-holes, the press-fit portions closely contact (pressure contact) plated interior surfaces of the through-holes, while flexing in a direction perpendicular to an axial direction of the compliant pins. The compliant pins are thereby fixed to the circuit boards, and favorable electrical connections are established between the compliant pins and circuits of the circuit board without having to solder the contact portions there between. Because there are cases in which forces are applied to the compliant pins in a direction of extraction, it is desirable for the contact pressure generated between the compliant pins and the through-holes to be 10 Newtons or greater in order to maintain an electrically stable connection there between. These forces may be applied, for example, during the mounting and removal of electrical connectors or due to external factors.

One example of a compliant pin is disclosed in Japanese Patent Publication No. 58(1983)-041633. This compliant pin comprises a press-fit portion having a slot extending in a longitudinal direction of the compliant pin. Ends of the slot are displaced in opposite directions along a surface in which the slot is formed. The configuration of the press-fit portion allows for slight elastic deformation of the press-fit portion in a radial direction (direction of displacement).

In another example, Japanese Unexamined Patent Publication No. 2002-231354 discloses a press in terminal. This terminal comprises a press-fit portion having an aperture extending in a longitudinal direction of the terminal. Edges of the aperture are pulled in opposite directions, to cause the shape of the press-fit portion to form an approximate oval shape. An outer portion of the oval flexes inward when the press-fit portion is press-fit into a through-hole of a circuit board. The press-fit portion contacts the through-hole and is fixed therein.

Compliant pins, which are formed in this manner, are used in electrical components, such as electrical connectors. When an electrical component is mounted onto a circuit board, the compliant pins simultaneously fix the electrical component to the circuit board and establish electrical connections between the electrical component and the circuit board. Accordingly, it is desirable for the press-fit portions of the compliant pins to have a large holding force over long periods of time. It is also desirable that the force required to insert the compliant pins into the circuit board be low to facilitate mounting the electrical component onto the circuit board. Because the compliant pins are formed from high strength materials and the press-fit portions are structured to generate great contact pressure with slight displacement, the circuit board must be formed from thick high strength materials in order to be able to withstand the contact pressure applied by the compliant pins. The diameters of the through-holes in the circuit boards are therefore limited to a narrow range.

Reduction of damage to the plating layers formed on the interior surfaces of the through-holes during insertion and extraction of the compliant pins into the circuit board is also desired to enable multiple insertions and extractions of the compliant pins into and from the circuit board. The ability to insert and extract the compliant pins allows for the electrical components that are mounted on the circuit boards to be temporarily removed for replacement or for service and then reused. However, if the electrical component or the circuit board is damaged during removal, either or both the electrical component and the circuit board become unusable and must be discarded. Additionally, due to the miniaturization of electronic devices in recent years, it is desirable that circuit boards be miniaturized and/or made thin. Excessive contact pressure may deform or destroy the circuit boards, thereby precluding the desired performance thereof.

In order to increase the holding force of the compliant pins, the engagement of the compliant pins with the through-holes can be made tighter. However, there is a possibility that doing so would increase the force required to insert the pins and also cause damage to the through-holes. For this reason, "barbs" are provided on the complaint pins to increase the holding force thereof without increasing the insertion force. Japanese Patent Publication No. 60(1985)-008379 discloses an example of a complaint pin provided with a "barb". This compliant pin comprises a planar press-fit portion having an upper edge thereof cut and formed to have a tongue piece that extends away from the press-fit portion in a cantilevered manner. The tongue piece protrudes outward from an outer edge of the press-fit portion. When the compliant pin is inserted into a through-hole of a circuit board, the tongue piece elastically deforms toward an interior thereof and engages with an inner surface of the through-hole. Accordingly, a holding force is exerted against forces applied in a direction of extraction of the compliant pin from the through-hole.

The compliant pins disclosed in Japanese Patent Publication No. 58(1983)-041663 and the terminals disclosed in Japanese Unexamined Patent Publication No. 2002-231354 have press-fit portions with substantially smooth outer surfaces. The press-fit portion therefore possesses no resistance against forces applied in a direction of extraction from the through-holes. Accordingly, it is necessary to increase the contact pressure exerted by the press-fit portions against the inner surfaces of the through-holes in order to increase resistance against extraction. Increasing the contact pressure, however, would increase the insertion pressure, which may damage the plating layers or the circuit board. On the other hand, the construction of the compliant pin disclosed in Japanese Patent Publication No. 60(1985)-008379 possesses resistance against forces applied in a direction of extraction, however, there is a possibility that the cut and bent tongue piece may be deformed or that the plated inner surface of the through-hole may be damaged, if the compliant pin is forcefully extracted. Additionally, the tongue piece has a complex shape and is difficult to manufacture. Further, the elasticity of the tongue piece may fluctuate, which will result in fluctuations in the contact pressure and the holding force exerted thereby.

BRIEF SUMMARY OF THE INVENTION

It is therefore an object of the invention to provide a compliant pin that can be positively mounted in a through-hole of a circuit board over a long period of time by excessively increasing the contact pressure exerted thereby without damaging the circuit board.

This and other objects are achieved by a compliant pin comprising a contact portion and a tine portion. The tine portion has an elastic press-fit portion with displaceable contact arms extending in opposite directions from each other. Each of the contact arms has an arcuate outer surface provided with a step. The step has an engaging surface extending substantially perpendicular to the press-fit portion.

This and other objects are further achieved by an electrical component comprising a housing having a plurality of compliant pins. A circuit board is provided with though-holes. Each of the through-holes has an inner surface with a plating layer. Each of the compliant pins has an elastic press-fit portion with an outer surface provided with a step. The step has an engaging surface that engages the plating layer of the though-hole to secure the compliant pin therein. The engaging surface has a width in a direction substantially perpendicular to the inner surface of the through-hole smaller than a thickness of the plating layer.

DETAILED DESCRIPTION OF THE INVENTION

Figure 1:
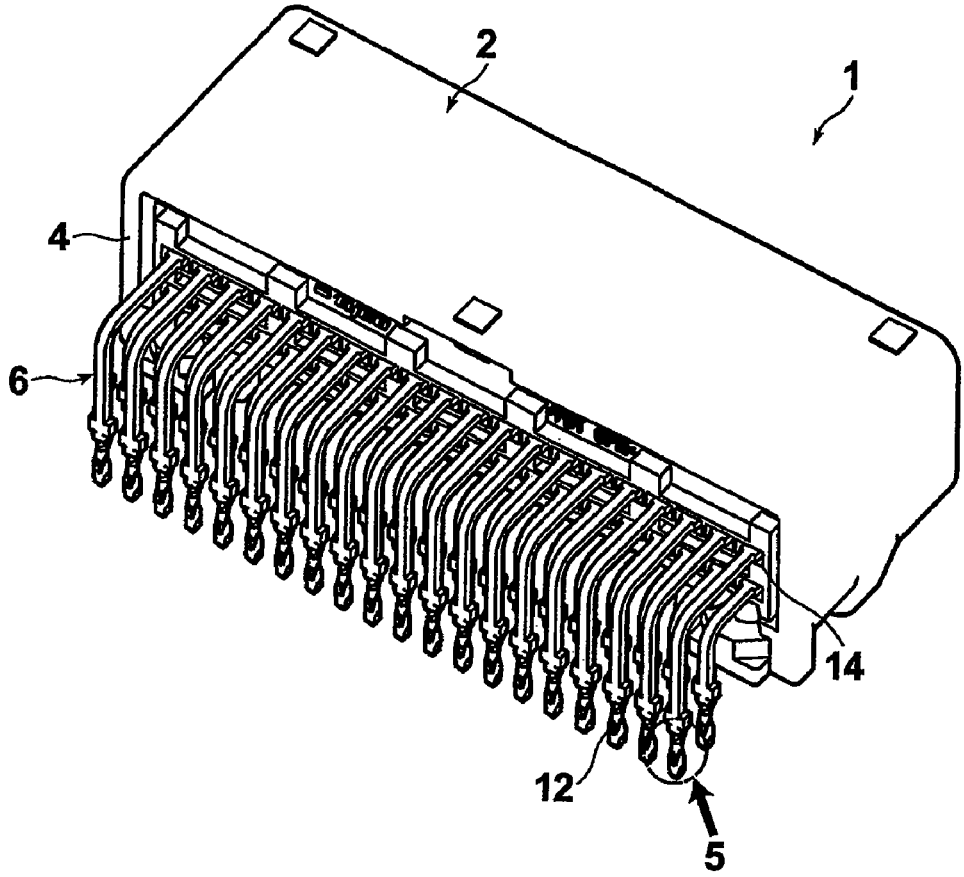
FIG. 1 is a perspective view from a rear of an electrical connector that utilizes compliant pins according to the invention.
Figure 2:
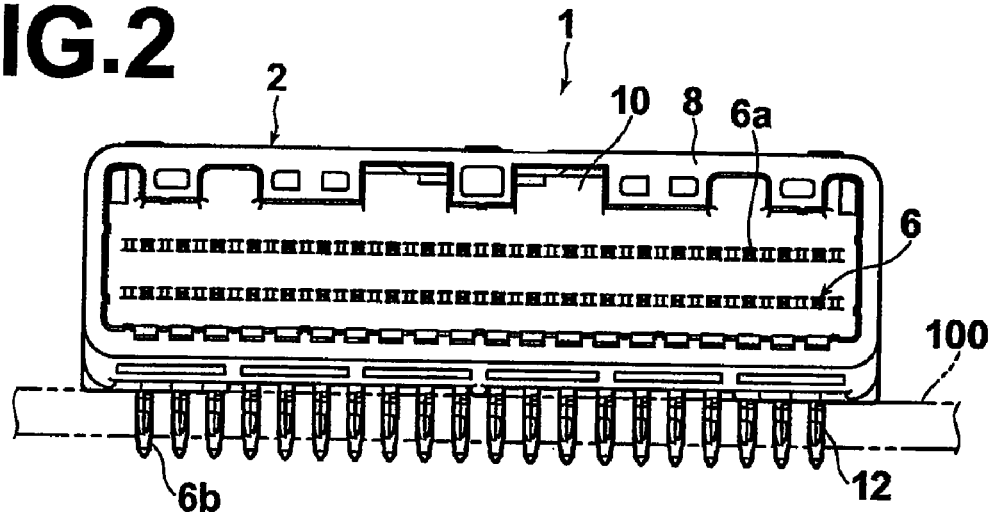
FIG. 2 is a front view of the electrical connector of FIG. 1 shown from an engagement surface thereof.

FIGS. 1-2 show an electrical component 1, such as an electrical connector. The electrical component 1 comprises a substantially parallelepiped insulative housing 2 having an engagement surface 8 at a side thereof with an engagement recess 10 for receiving another connector (not shown). Pin inserting apertures 14 extend through a rear surface 4 of the housing 2 and into the engagement recess 10. A plurality of compliant pins 6 are arranged in rows at predetermined intervals on a rear surface 4 of the housing 2. Each of the compliant pins 6 comprises a linearly extending contact portion 6*a*, which is provided within the engagement recess 10, for contacting contacts (not shown) of the other connector (not shown). A tine portion 6*b* extends rearward from the rear surface 4 of the housing 2. The tine portion 6*b* is then bent at substantially a right angle toward a circuit board 100. A press-fit portion 12, which is press-fit into and fixed to the circuit board 100, is formed on the tine portion 6*b*.

Figure 3A:
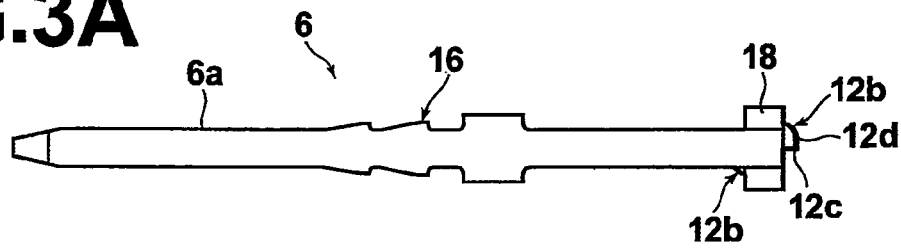
FIG. 3A is a plan view of the compliant pin.
Figure 3B:
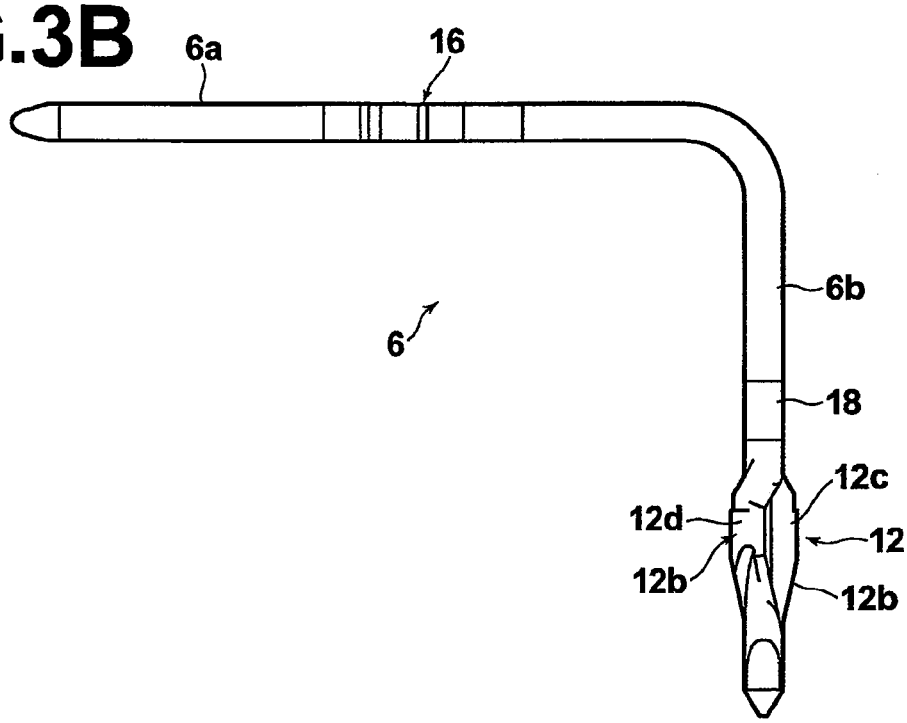
FIG. 3B is a front view of the compliant pin.
Figure 3C:
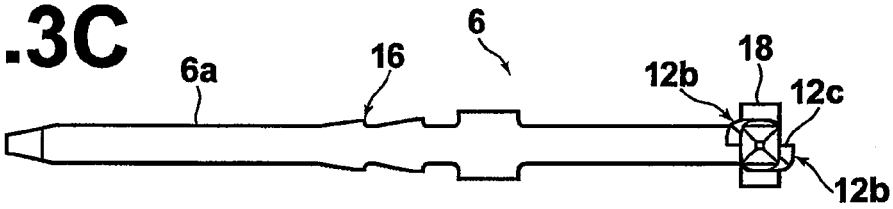
FIG. 3C is a bottom view of the compliant pin.

The compliant pins 6 will now be described in greater detail with reference to FIGS. 3A-5. As shown in FIGS. 3A-3C, the compliant pin 6 comprises the linearly extending contact portion 6*a* and the tine portion 6*b*. The tine portion 6*b* is continuous with the contact portion 6*a* and is substantially L-shaped. A fixing portion 16 comprising an uneven surface formed, for example, by protrusions and recesses, is provided between the contact portion 6*a* and the tine portion 6*b*. The fixing portion 16 is press-fit into the pin inserting apertures 14 of the housing 2.

Figure 4C:
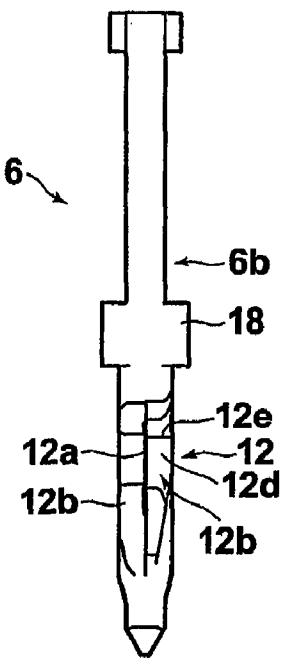
FIG. 4C is a right side view of the compliant pin.
Figure 4B:
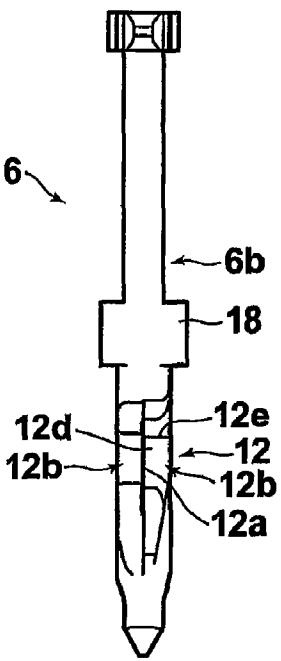
FIG. 4B is a left side view of the compliant pin.
Figure 4A:
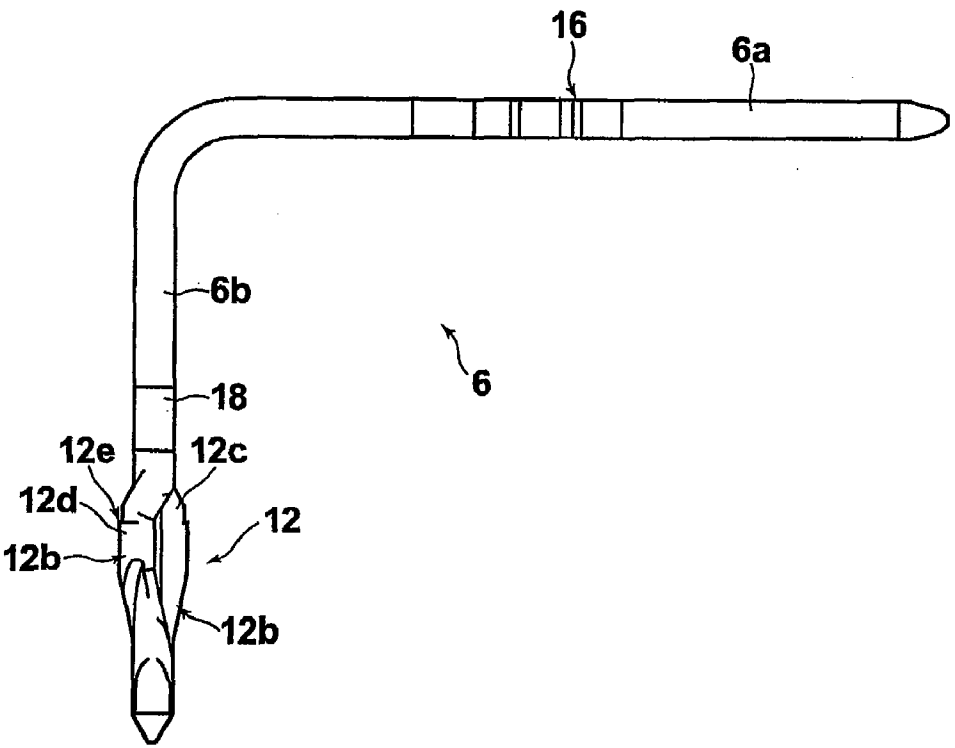
FIG. 4A is a rear view of the compliant pin.

The press-fit portion 12 is formed at the lower portion of the tine portion 6*b* and corresponds to a position of the circuit board 100. A circuit board abutment tab 18 is formed above the press-fit portion 12 and positions the compliant pin 6 relevant to the circuit board 100. As shown in FIGS. 4B-4C, a slit 12*a* is formed in the press-fit portion 12 and extends in substantially the same direction that the contact portion 6*a* extends. Two sides of the slit 12*a* are displaced so as to separate from each other along the slit 12*a*, to form a pair of contact arms 12*b*. The contact arms 12*b* swell out in opposite directions from each other, as shown in FIG. 4A. The contact arms 12*b* may be of the same shape and are rotationally symmetrical. This configuration allows elasticity to be imparted to the contact arms 12*b*. Additionally, this configuration allows the contact arms 12*b* to be capable of slight movement toward each other along the slit 12*a*.

Figure 5:
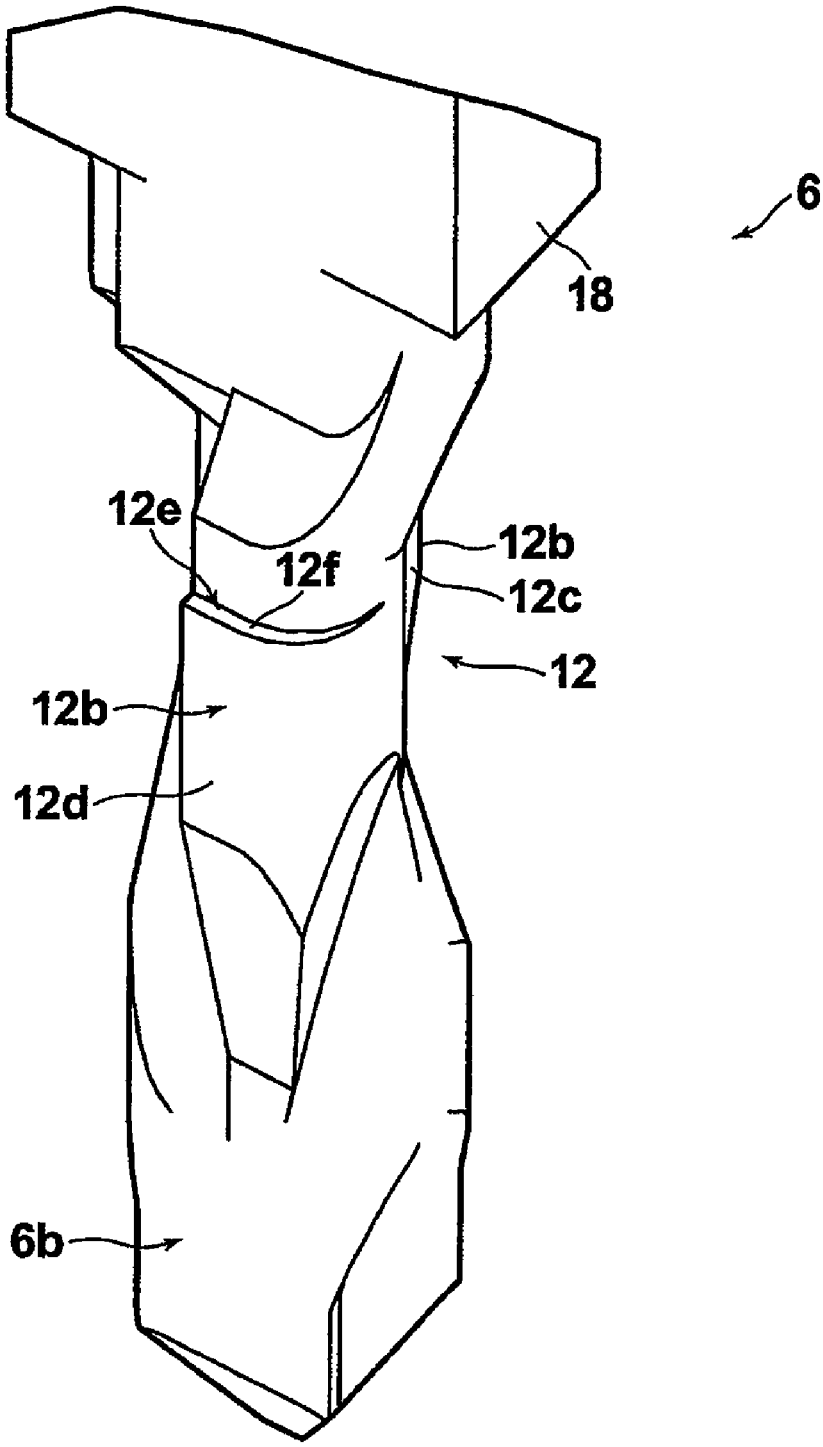
FIG. 5 is a magnified partial perspective view of the compliant pin taken along arrow 5 of FIG. 1.

As shown in FIG. 5, each of the contact arms 12*b* comprises a substantially flat surface 12*c* formed by the slit 12*a* and an arcuate outer surface 12*d*. The arcuate outer surface 12*d* is provided with a step 12*e* formed, for example, by a coining process by which the arcuate outer surface 12*d* is deformed to have protrusions and recesses in a desired pattern by, for example, a press. The step 12*e* is formed along a periphery of the arcuate outer surface 12*d*. The step 12*e* has an upward facing engaging surface 12*f* formed as a band along the outer periphery of the arcuate outer surface 12*d*. The width of the engaging surface 12*f* in a direction substantially perpendicular to an inner surface of an through-hole 102 (FIG. 6) of the circuit board 100 is smaller than the thickness of a plating layer 104, which is formed on the inner surface and periphery of the through-hole 102. The width of the engaging surface 12*f* is in a range, for example, of 30% to 50% or approximately ⅓ to ½ of the thickness of the plating layer 104. The width of the engaging surface 12*f* is greater along a direction of displacement of the contact arm 12*b* and decreases as the arcuate outer surface 12*d* becomes substantially parallel to the substantially flat surface 12*c*. In other words, the width of the engaging surface 12*d* is greatest at a position where the contact arm 12*b* exerts the greatest contact pressure. It should be noted that the dimensions of the engaging surface 12*f* are exaggerated in FIG. 5 for ease of description.

Figure 6:
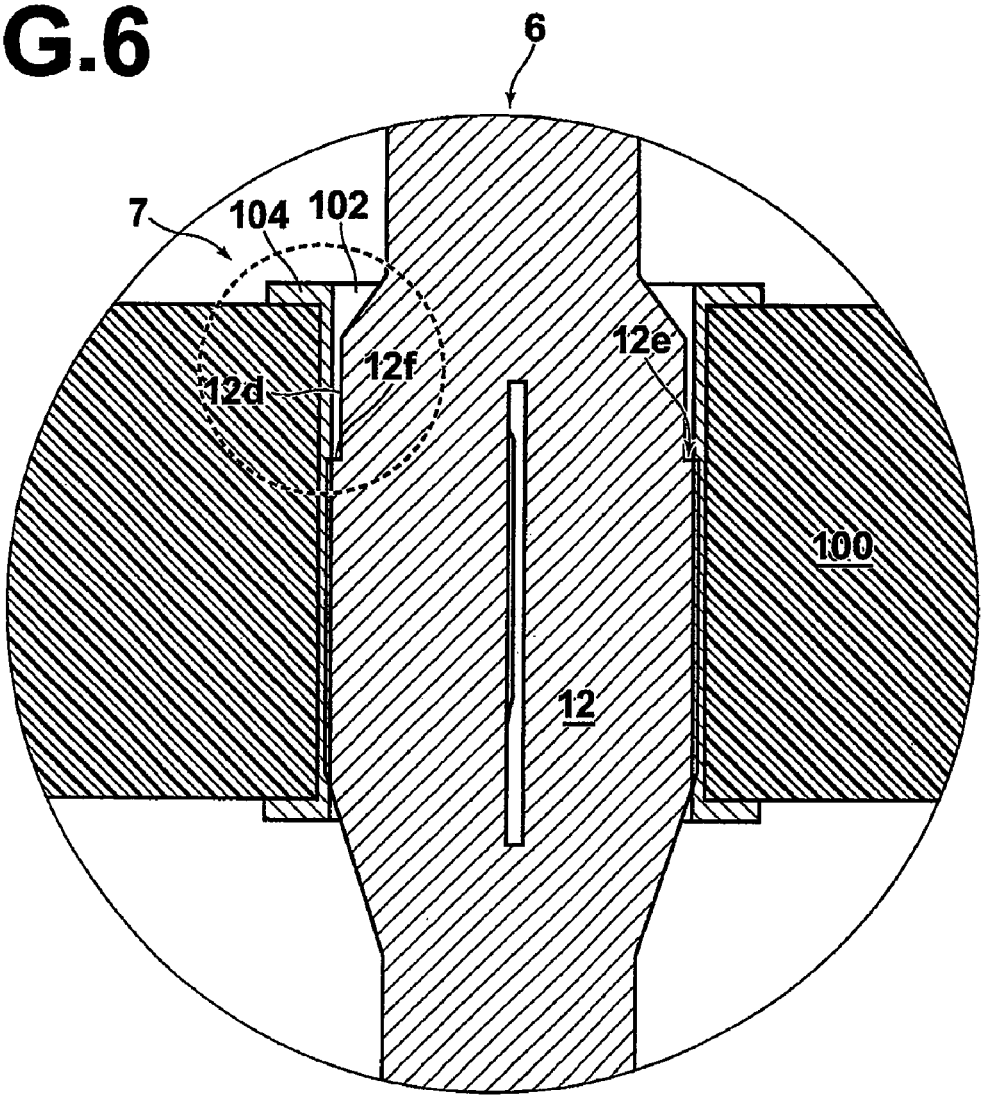
FIG. 6 is an enlarged partial sectional view that illustrates the state in which the compliant pin is press-fit into a circuit board.
Figure 7:
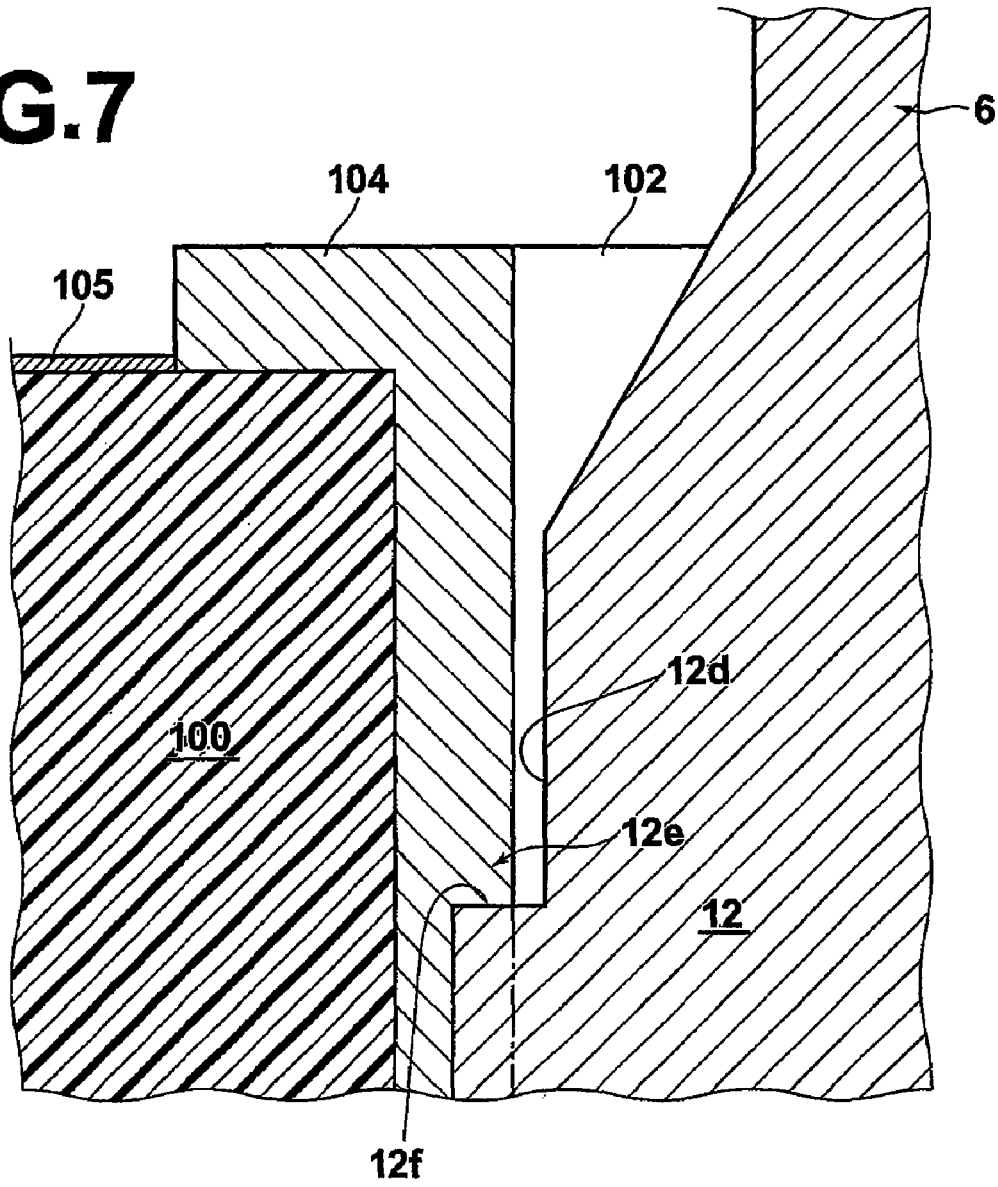
FIG. 7 is an enlarged partial sectional view of the circular area indicated by arrow 7 of FIG. 6.

As shown in FIGS. 6-7, a plurality of the through-holes 102 are formed in the circuit board 100 at positions corresponding to the compliant pins 6. The copper plating layer 104 is formed on the inner surfaces and the peripheries of each of the through-holes 102. The thickness of the plating layer 104 may be, for example, about 50 μm. A printed circuit 105, which is electrically linked to the plating layers 104, is formed on the surface of the circuit board 100.

The method of press-fitting the compliant pins 6 into the circuit board 100 will now be described with reference to FIGS. 6-7. It should be noted that the dimensions of the elements shown in FIG. 7 are exaggerated for ease of description. When the press-fit portions 12 of the compliant pins 6 are press-fit into the through-holes 102, the press-fit portions 12 are slightly compressed in a horizontal direction due to their elasticity, as shown in FIG. 6. At this time, the steps 12*e* of the arcuate outer surfaces 12*d* bite into the plating layer 104. Because the width of the engaging surfaces 12*f* of the steps 12*e* is smaller than the thickness of the plating layer 104, the plating layer 104 is not damaged. After a predetermined amount of time passes, the synergistic effect of the elasticity of the press-fit portions 12 and the steps 12*e* causes the inner surfaces of the through-holes 102 to accommodate the shape of the steps 12*e*. Accordingly, the steps 12*e* function as "burrs" and prevent the extraction of the compliant pin 6 from the through-holes 102.

The engaging surfaces 12*f* of the steps 12*e*, which are constructed in this manner, exhibit resistance against forces in the extraction direction. In the case that the compliant pins 6 are removed, a single insertion/extraction operation will not separate or destroy the plating layers 104. Therefore, the compliant pins 6, the circuit board 100, and the electrical component 1 can be reused. Additionally, because the step 12*e* is formed by a coining process, the manufacture thereof is easy and the dimensional accuracy thereof is high. In addition, the width of the engaging surface 12*f* does not change even if external forces are applied to the step 12*e* during shipping or handling of the pin 6. The performance and the quality of the pin 6 are therefore stabilized, because uniform dimensions are maintained.

Accordingly, the compliant pin 6 that can be positively mounted in the through-hole 102 of the circuit board 100 over a long period of time, without damaging the circuit board 100 by excessively increasing the contact pressure exerted thereby is provided. Because the size of the step 12*e* is smaller than the thickness of the plating layer 104, the force required to insert the compliant pin 6 is not increased. In addition, when the compliant pin 6 or the electrical component 1 that utilizes the compliant pin 6 is removed from the circuit board 100 for maintenance or the like, the plating layer 104 is not destroyed, due to the small size of the step 12*e*. Still further, the reliable electrical connections between the electrical component 1 and the circuit board 100 can be maintained for long periods of time.

Experimental data that illustrates the effects of the engaging surface 12*f* will be illustrated in Table 1. Table 1 lists data regarding twenty samples of the compliant pins 6, on which the engaging surfaces 12*f* were formed, and twenty samples of compliant pins, on which the engaging surfaces 12*f* were not formed.

TABLE 1

| | With Engaging Surface 1.26 mm 0.92 mm | | | Without Engaging Surface 1.26 mm 0.92 mm | | |
|---|---|---|---|---|---|---|
| Pin Diameter Aperture Diameter | Displacement (mm) | Contact Pressure (N) | Holding Force (N) | Displacement (mm) | Contact Pressure (N) | Holding Force (N) |
| 1 | 0.34 | 239.40 | 26.05 | 0.34 | 239.40 | 21.15 |
| 2 | 0.34 | 239.40 | 28.70 | 0.34 | 239.40 | 19.80 |
| 3 | 0.34 | 239.40 | 31.50 | 0.34 | 239.40 | 23.45 |
| 4 | 0.34 | 239.40 | 26.30 | 0.34 | 239.40 | 25.10 |
| 5 | 0.34 | 239.40 | 34.10 | 0.34 | 239.40 | 20.95 |
| 6 | 0.34 | 239.40 | 26.20 | 0.34 | 239.40 | 23.70 |
| 7 | 0.34 | 239.40 | 27.70 | 0.34 | 239.40 | 26.85 |
| 8 | 0.34 | 239.40 | 26.25 | 0.34 | 239.40 | 21.90 |
| 9 | 0.34 | 239.40 | 26.10 | 0.34 | 239.40 | 21.35 |
| 10 | 0.34 | 239.40 | 27.25 | 0.34 | 239.40 | 23.15 |
| 11 | 0.34 | 239.40 | 27.85 | 0.34 | 239.40 | 26.95 |
| 12 | 0.34 | 239.40 | 31.60 | 0.34 | 239.40 | 24.15 |
| 13 | 0.34 | 239.40 | 33.35 | 0.34 | 239.40 | 24.90 |
| 14 | 0.34 | 239.40 | 28.85 | 0.34 | 239.40 | 25.80 |
| 15 | 0.34 | 239.40 | 26.35 | 0.34 | 239.40 | 25.85 |
| 16 | 0.34 | 239.40 | 30.05 | 0.34 | 239.40 | 27.75 |
| 17 | 0.34 | 239.40 | 37.20 | 0.34 | 239.40 | 26.30 |
| 18 | 0.34 | 239.40 | 31.15 | 0.34 | 239.40 | 24.30 |
| 19 | 0.34 | 239.40 | 35.40 | 0.34 | 239.40 | 27.70 |
| 20 | 0.34 | 239.40 | 23.90 | 0.34 | 239.40 | 26.10 |

In Table 1, the column "displacement" represents the distance that the press contact arms 12*b* flexed when the compliant pins 6 were inserted into the through-holes 102. The column "contact pressure" represents the force (in Newtons) in the radial direction, calculated from the displacement. The column "holding force" represents the force (in Newtons) required to pull the compliant pins 6 out of the circuit board 100. The "holding force" was measured by the amount of force (in Newtons) required to press the compliant pins 6 out of the circuit board 100, from a bottom surface thereof. The measurements were taken about 24 hours following insertion of the compliant pins 6 into the circuit board 100. It should be noted that the compliant pins 6 were gold plated. As can be seen from the results of Table 1, the "holding force" was greater in the compliant pins 6, on which the engaging surface 12*f* was formed, for almost all of the samples. Thus, the compliant pins 6, on which the engaging surfaces 12*f* have been formed, are unlikely to be extracted from the through-holes 102.

The foregoing illustrates some of the possibilities for practicing the invention. Many other embodiments are possible within the scope and spirit of the invention. For example, at least one recess (not shown) may be formed by a coining process in the arcuate outer surface 12*d*, instead of the step 12*e*. The recess (not shown) may have an edge which is positioned toward the leading end in the insertion direction. By this configuration, an upward facing engaging surface, (an engaging surface that faces the direction opposite the insertion direction) is formed in the recess (not shown). This engaging surface operates as an extraction preventing mechanism in a manner similar to that of the engaging surface 12*f* of the step 12*e*. It is, therefore, intended that the foregoing description be regarded as illustrative rather than limiting, and that the scope of the invention is given by the appended claims together with their full range of equivalents.

What is claimed is:

1. A compliant pin, comprising:

a contact portion and a tine portion, the tine portion having an elastic press-fit portion with displaceable contact arms extending in opposite directions from each other, the contact arms being offset with respect to each other in separate planes, each of the contact arms having an arcuate outer surface provided with a step, the step having an engaging surface extending substantially perpendicular to the press-fit portion.

2. The compliant pin of claim 1, wherein the width of the engaging surface is greater along a direction of displacement of the contact arms.

3. The compliant pin of claim 1, wherein the tine portion is continuous with the contact portion and is substantially L-shaped.

4. The compliant pin of claim 1, further comprising a fixing portion formed between the contact portion and the tine portion, the fixing portion having an uneven surface.

5. The compliant pin of claim 1, further comprising a circuit board abutment tab formed between the press-fit portion and the contact portion.

6. The compliant pin of claim 1, wherein a slit is formed between the contact arms.

7. The compliant pin of claim 1, wherein the contact arms are symmetrical about a common axis.

8. The compliant pin of claim 1, wherein the engaging surface faces toward the contact portion.

9. An electrical component, comprising:

a housing having a plurality of compliant pins;

a circuit board having though-holes, an inner surface of the through-holes having a plating layer; and each of the compliant pins having an elastic press-fit portion with an outer surface provided with a step, the step having an engaging surface facing away from a direction of insertion of the compliant pin into the through-hole that engages the plating layer of the though-hole to prevent extraction of the compliant pin from the through-hole, the engaging surface having a width in a direction substantially perpendicular to the inner surface of the through-hole that is smaller than a thickness of the plating layer.

10. The electrical component of claim 9, wherein the plating layer is copper.

11. The electrical component of claim 9, wherein the outer surface is arcuate.

12. The electrical component of claim 9, wherein the width of the engaging surface is approximately ⅓ to ½ of the thickness of the plating layer.

13. The electrical component of claim 9, wherein the press-fit portion includes displaceable contact arms extending in opposite directions from each other.

14. The electrical component of claim 13, wherein the outer surface is on the contact arms.

15. The electrical component of claim 13, wherein the width of the engaging surface is greater along a direction of displacement of the contact arms.

16. The electrical component of claim 13, wherein a slit is formed between the contact arms.

17. The electrical component of claim 13, wherein the contact arms are rotationally symmetrical.

18. The electrical component of claim 9, wherein the press-fit portion is formed on a tine portion of the compliant pin, the tine portion being substantially L-shaped and continuous with a contact portion that is received in the housing.

19. The electrical component of claim 18, wherein each of the compliant pins includes a fixing portion formed between the contact portion and the tine portion that engages the housing, the fixing portion having an uneven surface.

20. The electrical component of claim 18, further comprising a circuit board abutment tab formed between the press-fit portion and the contact portion that engages a surface of the circuit board.

* * * * *